US010758901B2

(12) United States Patent
Lehtinen et al.

(10) Patent No.: US 10,758,901 B2
(45) Date of Patent: Sep. 1, 2020

(54) APPARATUS, SYSTEM AND METHOD FOR FILTERING LIQUID SAMPLES

(75) Inventors: Kauko Lehtinen, Naantali (FI); Jarmo Korpi, Nousiainen (FI)

(73) Assignee: WALLAC OY, Turku (FI)

( * ) Notice: Subject to any disclaimer, the term of this patent is extended or adjusted under 35 U.S.C. 154(b) by 2550 days.

(21) Appl. No.: 13/126,062

(22) PCT Filed: Sep. 1, 2009

(86) PCT No.: PCT/FI2009/050691

§ 371 (c)(1),
(2), (4) Date: Apr. 24, 2013

(87) PCT Pub. No.: WO2010/026290

PCT Pub. Date: Mar. 11, 2010

(65) Prior Publication Data

US 2013/0248466 A1 Sep. 26, 2013

(30) Foreign Application Priority Data

Sep. 2, 2008 (FI) ..... 20085815

(51) Int. Cl.
*B01L 3/00* (2006.01)
*B01L 3/02* (2006.01)

(52) U.S. Cl.
CPC ..... *B01L 3/50255* (2013.01); *B01L 3/0231* (2013.01); *B01L 3/565* (2013.01);
(Continued)

(58) Field of Classification Search
CPC ..... B01L 2300/0829; B01L 2300/0861; B01L 2400/0478; B01L 3/5023; B01L 3/5025; B01L 3/50255
(Continued)

(56) References Cited

U.S. PATENT DOCUMENTS 4,948,564 A 8/1990 Root et al.
5,141,719 A 8/1992 Fernwood et al.
(Continued)

FOREIGN PATENT DOCUMENTS

DE 10 2005 026 585 A1 11/2006
EP 1 712 285 A1 10/2006
WO 2005/119253 A1 12/2005

OTHER PUBLICATIONS

International Search Report, dated Dec. 21, 2009, from corresponding PCT application.
(Continued)

*Primary Examiner* — Jill A Warden
*Assistant Examiner* — Dwayne K Handy
(74) *Attorney, Agent, or Firm* — Nixon & Vanderhye

(57) ABSTRACT

An apparatus and a system for filtering a liquid sample in a sample well (310) by transferring the liquid out of the sample well (310) through a filter member (320) situated at a bottom part of the sample well (310). The apparatus and the system include a syringe (100), and a seal member (200) arranged around a nozzle (140) of the syringe (100) in such a way that the syringe (100) is adjustable in connection with an upper part of the sample well (310) in a substantially airtight manner. A method for filtering a liquid sample and use of the system for filtering eluted blood are also disclosed.

12 Claims, 2 Drawing Sheets

(52) U.S. Cl.
CPC ..... *B01L 2300/0829* (2013.01); *B01L 2400/0478* (2013.01)

(58) Field of Classification Search
USPC ..... 422/513, 534, 551, 553
See application file for complete search history.

(56) References Cited

U.S. PATENT DOCUMENTS

| | | | | |
|---|---|---|---|---|
| 5,736,105 | A * | 4/1998 | Astle | B01L 3/0279 422/509 |
| 6,338,802 | B1 | 1/2002 | Bodner et al. | |
| 2002/0106787 | A1 | 8/2002 | Benn et al. | |
| 2002/0182718 | A1* | 12/2002 | Malmquist | B01F 11/0082 435/287.2 |
| 2004/0018119 | A1* | 1/2004 | Massaro | B01L 3/022 422/509 |
| 2004/0120860 | A1 | 6/2004 | Ingenhoven | |
| 2006/0024211 | A1 | 2/2006 | Giter et al. | |
| 2008/0138251 | A1* | 6/2008 | Dumitrescu | B01L 3/5082 422/562 |
| 2010/0242634 | A1 | 9/2010 | Hubbuch et al. | |

OTHER PUBLICATIONS

Finnish Search Report, dated Jul. 23, 2009, from corresponding Finnish application.

* cited by examiner

APPARATUS, SYSTEM AND METHOD FOR FILTERING LIQUID SAMPLES

TECHNICAL FIELD OF THE INVENTION

The present invention relates to an apparatus, a system and a method for filtering liquid samples according to the preambles of the appended independent claims. The invention also concerns use of the system according to the invention for filtering eluted blood.

BACKGROUND OF THE INVENTION

Multi-well filtration is a commonly used technique in chemistry and biochemistry for simultaneous filtering of suspensions contained in sample wells of a sample plate. Typically, the suspensions in the wells are first processed, for example, by eluting by means of a solvent or by using a reagent to precipitate one of the materials, and then the suspensions are filtered simultaneously to separate the desired material.

Conventional multi-well filtration assemblies typically comprise a filtration plate, or a separation plate, having a plurality of wells for receiving a liquid sample, and a collection plate having a plurality of wells for collecting filtrate. The filtration plate and the collection plate are disposed in a stacked relationship such that individual collection wells are aligned with a single filtration well. A conventional multi-well filtration plate, such as a microtiter plate, has 96 or 384 wells arranged in a 2:3 rectangular matrix for performing multiple assays simultaneously. Each well typically contains a separation media, for example a filter membrane, for separating a component from the fluid that is introduced into the separation plate, and allowing a liquid portion of the fluid to filter into the collection plate.

Depending on the application, either underpressure or overpressure is typically used in a multi-well filtration assembly to force the liquid through the separation media. Typically, the filtration assembly comprises a housing having means for producing the differential pressure.

Document U.S. Pat. No. 6,338,802 discloses a microfiltration apparatus for processing a plurality of fluid samples. The apparatus comprises a first plate having a plurality of columns, each column containing at one end thereof a filter element and a fluid discharge conduit beneath the filter element, and a second plate spaced apart from the first plate by a cavity, the second plate having a plurality of collection wells aligned with the columns for receiving sample fluid from the discharge conduits. The second plate also comprises a plurality of vents extending through the second plate adjacent the collection wells. The apparatus also comprises a gas-permeable material positioned in the cavity between the first plate and the second plate wherein the gas-permeable material is effective to permit a vacuum drawn from beneath the second plate to extend, via the vents, to a region above the second plate and to the plurality of columns, thereby drawing fluid from the columns into the collection wells and to obstruct movement of aerosols across the top of the second plate, thereby discouraging cross-contamination between the wells.

Document U.S. Pat. No. 5,141,719 describes a plate assembly for performing filtration on a plurality of samples. The assembly comprises an upper plate having a plurality of apertures, a single sheet of porous material of sufficient dimensions to span the entire plurality of the apertures, a rigid single-piece drop guide plate with a plurality of tubes incorporated therein, and a lower plate having a plurality of wells aligned with the apertures and the tubes. The assembly also comprises means for drawing a vacuum through the upper plate, drop guide plate and lower plate in order to draw liquid from the apertures through the tubes into the wells.

A drawback of known multi-well filtration apparatuses is that when using negative or positive pressure in a filtration process, a single defective sample well can disturb filtration in all the other wells, due to pressure leakage through the defective well. Known apparatuses have also turned out unreliable, some of the samples being filtered only partly in the filtration process. Problems have also arisen from drops dripping from a filtration well into a collection well at the end of and after the filtration process. Moreover, known apparatuses are difficult and complex to automate, and expensive to manufacture.

DESCRIPTION OF THE INVENTION

It is the main objective of the present invention to reduce or even eliminate prior art problems presented above.

It is an objective of the invention to provide an apparatus, a system and a method for filtering liquid samples efficiently and accurately.

It is also an objective of the invention to provide an apparatus, a system and a method for filtering liquid samples in sample wells of a sample plate so that the defective wells of the sample plate do not disturb filtration processes in the other wells.

It is also an objective of the invention to provide an apparatus, a system and a method for filtering liquid samples in sample wells of a sample plate so that the problem of dripping drops at the end of and after filtration can be avoided.

It is a further objective of the present invention to provide a system for filtering a plurality of liquid samples in sample wells simultaneously. It is also an objective of the present invention to provide a system for filtering a plurality of liquid samples in sample wells independently.

In order to realise the above-mentioned objectives, the apparatus, the system and the method according to the invention are characterised by what is presented in the characterising parts of the appended independent claims. Advantageous embodiments of the invention are described in the dependent claims.

The exemplary embodiments of the invention presented in this text are not interpreted to pose limitations to the applicability of the appended claims. The verb "to comprise" is used in this text as an open limitation that does not exclude the existence of also unrecited features. The features recited in the dependent claims are mutually freely combinable unless otherwise explicitly stated.

A typical apparatus according to the invention, for filtering a liquid sample in a sample well by transferring the liquid out of the sample well through a filter member situated at a bottom part of the sample well, comprises a syringe. A typical apparatus according to the invention also comprises a seal member arranged around a nozzle of the syringe in such a way that the syringe is adjustable in connection with an upper part of the sample well in a substantially airtight manner.

The apparatus according to the invention can be used for filtering various liquids, such as biological fluids. The liquid is forced through the filter member by using controlled overpressure. The overpressure is generated by dispensing air into the sample well while keeping the syringe in a substantially airtight connection with the upper part of the sample well. The sample well can be a separate well, or a single well of a sample plate having a plurality of wells.

By a filter member it is meant a separation media that is suitable for separating one or more components from the liquid sample when the liquid is being transferred through the separation media. The filter member can be manufactured from materials such as porous plastic, wire mesh, paper or glass fibre. The filter member, which is situated at the bottom part of the sample well, can cover e.g. 10-30, 20-50, 40-70, 60-90 or even 100% of the surface area of the bottom of the sample well.

By a syringe it is meant a conventional laboratory instrument known from the prior art used to transport a measured volume of liquid and/or gas. The syringe comprises a cylinder for holding the measured volume of liquid and/or gas, a piston arranged in a movable manner within the cylinder and closing the cylinder, and a nozzle through which the liquid and/or the gas can be aspirated and dispensed.

A seal member is typically manufactured from an elastic material, such as silicone rubber, which provides an airtight connection between the syringe and the upper part of the sample well without the need of using a great pressing force. Typically, the seal member is arranged around the nozzle in such a way that when the syringe is in connection with the upper part of the sample well in a substantially airtight manner the syringe is not in contact with the sample well.

The connection between the syringe and the upper part of the sample well is "substantially airtight" when the liquid sample in the sample well can be transferred through the filter member by using the syringe which dispenses air into the sample well. In other words, the connection does not necessarily have to be completely airtight, as long as the apertures in the joint do not prevent filtration.

An advantage of the apparatus according to the invention is that a liquid sample in a sample well having a filter at its bottom part can be filtered easily.

According to an embodiment of the invention the seal member is arranged to be movable along an outer surface of the nozzle. An advantage of providing the seal member movable along the nozzle is that the distance between the tip of the syringe and the bottom of the sample well can be varied. By moving the seal member along the nozzle, the tip of the syringe can e.g. be arranged and kept at a certain distance above the liquid level. In some cases the tip of the syringe can be arranged below the liquid level, whereupon the liquid sample is being effectively mixed when dispensing air into the sample well.

According to a preferred embodiment of the invention the seal member is detachable from the nozzle. An advantage of a detachable seal member is that a seal member can be replaced with another one. By changing a seal member into a different type seal, the apparatus can be used with various type sample wells. Thus, the detachable seal member makes the apparatus according to the invention a versatile device.

According to an embodiment of the invention the seal member is a hollow cylinder. For a 96-well sample plate, an inner diameter of the cylinder can be e.g. 1-5 mm, preferably 2-3 mm. An outer diameter of the cylinder can be e.g. 8-9 mm. A length of the cylinder can be e.g. 0.1-10 mm, preferably 1-5 mm.

According to a preferred embodiment of the invention the end of the seal member contacting the upper part of the sample well is bevelled. The seal member can be bevelled in such a way that the bevelled end matches the form of the upper part of the sample well. An advantage of the bevelled end is that an airtight connection can be achieved with less force.

A typical system according to the invention for filtering liquid samples comprises a sample plate comprising a plurality of sample wells for holding the liquid samples, at least one of the sample wells having a filter member at a bottom part. A typical system also comprises an array of syringes and a control unit for controlling the operation of the syringes. In a typical system according to the invention at least one of the syringes comprises a seal member arranged around a nozzle of the syringe in such a way that the syringe is adjustable in connection with an upper part of a sample well of the sample plate in a substantially airtight manner.

A sample plate can be e.g. a conventional microplate or microtiter plate having for example 6, 24, 96, 384 or 1536 sample wells, which are arranged in a 2:3 rectangular matrix. Each well of a microplate typically has a volume of somewhere between a few to a few hundred microlitres, for example in the range of 1 to 5000 microlitres. The sample wells of the sample plate can be arranged in rows and columns, or into a line.

Preferably, each syringe of the system comprises a seal member arranged around a nozzle. Also preferably, all of the sample wells of the sample plate comprise a filter member.

An advantage of the system according to the invention is that defective wells of the sample plate do not disturb filtration processes in the other wells. Moreover, with the system according to the invention one or more sample wells can be filtered simultaneously.

According to an embodiment of the invention the control unit is arranged to control the operation of the syringes independently. The control unit can e.g. be arranged to move the pistons of the syringes by moving rods, which are connected to the pistons.

A typical method according to the invention for filtering a liquid sample in a sample well, the bottom part of the sample well having a filter member, comprises aspirating air into a syringe, adjusting the syringe in connection with an upper part of the sample well in a substantially airtight manner, and dispensing air from the syringe into the sample well, whereupon a portion of the liquid sample is being transferred out of the sample well through the filter member.

The amount of air being aspirated into the syringe and then dispensed into the sample well depends e.g. on the volume of the sample well. For a conventional 96-well sample plate, the amount of air used can be e.g. 0.5-2 ml or 1-3 ml.

According to an embodiment of the invention the method comprises directing the filtered portion of the liquid sample in another sample well. Preferably, the sample plate containing the liquid samples and the sample plate to which the filtered liquid samples are directed, are disposed in a stacked relationship so that the wells of the plates are aligned with each other.

According to an embodiment of the invention the method comprises aspirating air from the sample well into the syringe, whereupon the liquid is being drawn through the filter member into the sample well due to underpressure. An advantage of aspirating air after the filtration process, while still keeping the syringe in connection with the upper part of the sample well in a substantially airtight manner, is that the problem of dripping drops can be avoided.

The present invention also concerns use of the system according to the invention for filtering eluted blood. Eluted blood is typically produced by eluting blood with a protein solution comprising calcium. During an elution process, components of the blood serum are eluted into the eluate. Also at least some of the red blood cells break apart, whereby blood components such as haemoglobin and cell wall parts got into the eluate. Typically, the eluant also comprises paper fibre. With the use of the system according to the invention for filtering eluted blood the measuring problems due to a blood spot floating on the surface of the liquid can be avoided. Moreover, with the use of the system the paper fibre contained in the eluted blood can be removed.

BRIEF DESCRIPTION OF THE DRAWINGS

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1A:
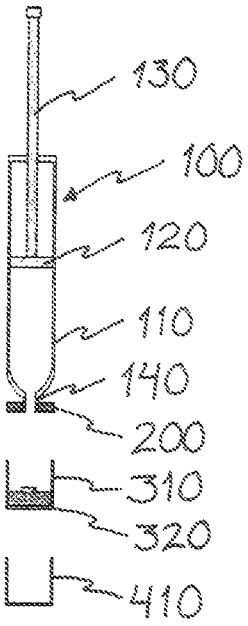
FIGS. 1A-1D illustrate the procedure of filtering a liquid sample by using an apparatus according to an embodiment of the invention.

FIGS. 1A-1D illustrate the procedure of filtering a liquid sample by using an apparatus according to an embodiment of the invention.

The apparatus for filtering the liquid sample comprises a syringe 100. The syringe 100 comprises a cylinder 110 for holding a measured volume of air, a piston 120 arranged in a movable manner within the cylinder 110, a rod 130 connected to the piston 120, and a nozzle 140 through which air can be aspirated and dispensed.

The apparatus also comprises a seal member 200 arranged around the nozzle 140 of the syringe 100. The seal member 200, which is manufactured from an elastic material, is arranged to be movable along an outer surface of the nozzle 140 so that the distance between the tip of the syringe 100 and a bottom of a first sample well 310 can be varied when the syringe 100 is in connection with an upper part of the first sample well 310 in a substantially airtight manner.

The liquid sample contained in the first sample well 310 has been processed to precipitate desired components of the sample. The first sample well 310 comprises a filter member 320 situated at the bottom part of the sample well 310. The filter member 320 is used for separating the precipitated components from the liquid when the liquid is being transferred through the filter member 320. A second sample well 410 has been arranged underneath the first sample well 310 in order to collect the filtrate, i.e. the liquid.

The first step of the filtering procedure is shown in FIG. 1A, wherein air is aspirated into the cylinder 110 by moving the rod 130. At this stage, the syringe 100 is not in contact with the first sample well 310. Next, as is shown in FIG. 1B, the syringe 100 is adjusted in connection with the upper part of the first sample well 310 in a substantially airtight manner.

Figure 1C:
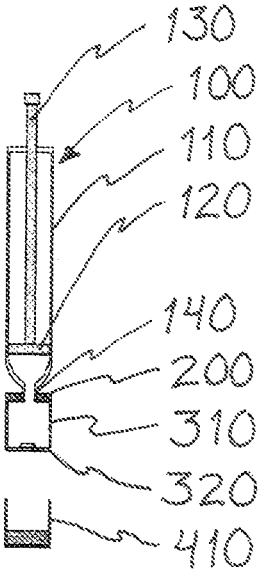
Figure 1B:
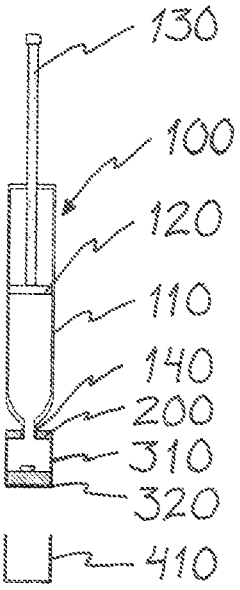

Then, as is shown in FIG. 1C, air is dispensed from the syringe 100 into the first sample well 310. The dispensed air generates overpressure, which forces the liquid through the filter member 320. The portion of the liquid being transferred through the filter member 320 is directed in the second sample well 410.

After a desired amount of the liquid sample has been filtered, underpressure is generated by aspirating air into the syringe 100, while still keeping the syringe 100 in connection with the upper part of the first sample well 310 in a substantially airtight manner. Consequently, liquid drops hanging from the filter member 320 are drawn into the first sample well 310.

Figure 1D:
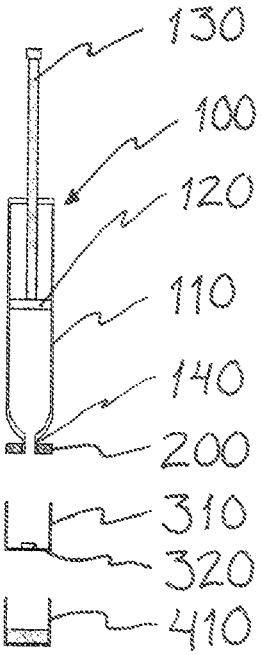

In the last step of the procedure, as is shown in FIG. 1D, the syringe 100 is moved away from contact with the first sample well 310.

Figure 2:
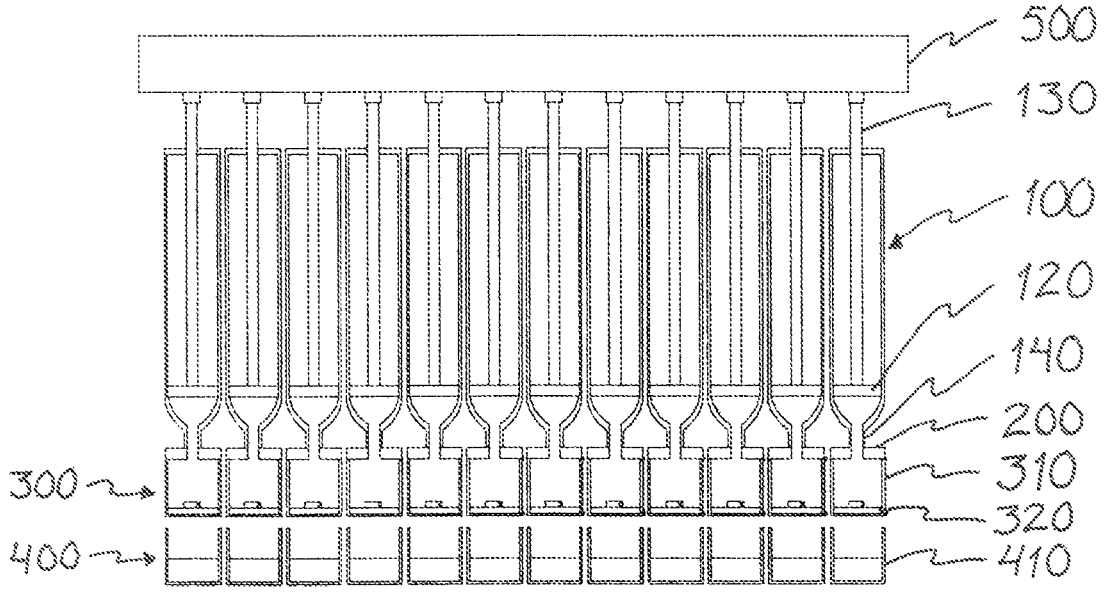
FIG. 2 illustrates a system according to an embodiment of the invention.

FIG. 2 illustrates a system according to an embodiment of the invention for filtering several liquid samples. The system comprises a first sample plate 300 having a plurality of first sample wells 310 for holding the liquid samples prior to filtering. Each of the first sample wells 310 has a filter member 320 at a bottom part.

The system also comprises an array of syringes 100. Each of the syringes 100 comprises a seal member 200 arranged around a nozzle 140 of the syringe 100. The syringes 100 are adjusted in connection with upper parts of the first sample wells 310 of the first sample plate 300 in a substantially airtight manner.

The system also comprises a control unit 500 for controlling the movement of rods 130. The rods 130, which are connected to pistons 120, are moved in a vertical direction either simultaneously or independently.

Underneath the first sample plate 300, there is a second sample plate 400 having a plurality of second sample wells 410. The first sample plate 300 and the second sample plate 400 are disposed in a stacked relationship such that the first sample wells 310 are aligned with the second sample wells 410.

Figure 3:
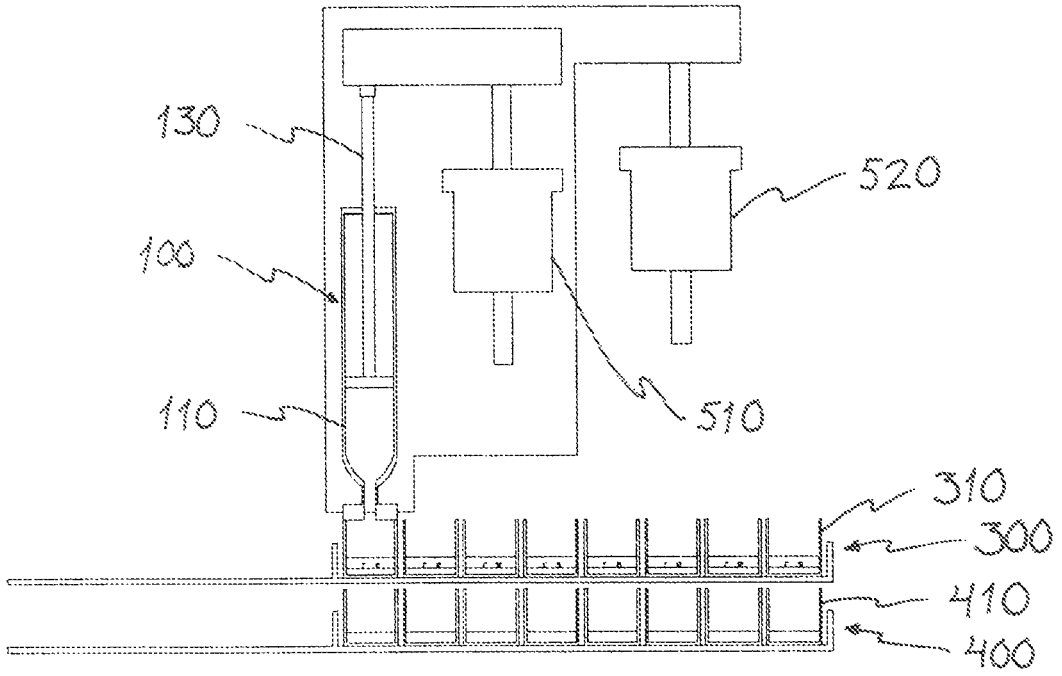
FIG. 3 illustrates a system according to another embodiment of the invention.

Another example of a system according to the invention is shown in FIG. 3. In FIG. 3, there is illustrated a first actuator 510 which is used for moving a rod 130 of the syringe 100 in order to aspirate air into the cylinder 110 and dispense air out of the cylinder 110. A second actuator 520 is adapted for moving the syringe 100 in a vertical direction, relative to a first sample plate 300 and a second sample plate 400. The sample plates 300, 400 are arranged to be movable in a horizontal direction in order to position each sample well 310, 410 underneath the syringe 100.

Only advantageous exemplary embodiments of the invention are described in the figures. It is clear to a person skilled in the art that the invention is not restricted only to the examples presented above, but the invention may vary within the limits of the claims presented hereafter. Some possible embodiments of the invention are described in the dependent claims, and they are not to be considered to restrict the scope of protection of the invention as such.

The invention claimed is:

1. A system for filtering liquid samples, the system comprising:

a sample plate comprising a plurality of sample wells configured to hold the liquid samples, each of the sample wells having a filter member at a bottom part thereof;

an array of syringes connectable to the plurality of the sample wells so that one syringe gets connected to one sample well, each of the syringes comprising a cylinder, a piston movable within the cylinder and connected to an end of a rod, and a seal member disposed around a nozzle of the syringe so that the seal member is in direct contact with an outer surface of a bottom portion of the nozzle, the seal member being configured to provide an airtight connection between the syringe and an upper part of a respective sample well of the sample plate by the seal member engaging with an upper part of a respective sample well such that the syringe is adjustable in connection with the upper part of the respective sample well of the sample plate in a substantially airtight manner; and a control unit configured to control the operation of the syringes by controlling movement of rods that are connected to the pistons of the respective syringes.

2. The system according to claim 1, wherein the control unit is configured to control the operation of the syringes independently.

3. The system according to claim 1, wherein the seal member is movable along an outer surface of the nozzle.

4. The system according to claim 1, wherein the seal member is detachable from the nozzle.

5. The system according to claim 1, wherein the seal member is a hollow cylinder.

6. The system according to claim 1, wherein the end of the seal member contacting the upper part of the sample well is bevelled.

7. A method for filtering liquid samples in a plurality of sample wells, each of the sample wells having a filter member at a bottom part thereof, the method comprising:

aspirating air into syringes of an array of syringes, each of the syringes comprising a cylinder and a piston movable within the cylinder and connected to an end of a rod;

adjusting the syringes in connection with upper parts of the sample wells in a substantially airtight manner so that one syringe is connected to one sample well and an airtight connection between the syringe and an upper part of the respective sample well is provided by a seal member disposed around a nozzle of the syringe engaging with the upper part of the respective sample well so that the seal member is in direct contact with an outer surface of a bottom portion of the nozzle; and dispensing air from the syringes into the sample wells, such that portions of the liquid samples are transferred out of the sample wells through the filter members, wherein the air is aspirated into the syringes and dispensed from the syringes by moving rods that are connected to the pistons of the respective syringes.

8. The method according to claim 7, further comprising directing the filtered portions of the liquid samples in other sample wells.

9. The method according to claim 7, further comprising aspirating air from the sample wells into the syringes, such that the liquid is drawn through the filter members into the sample wells due to underpressure.

10. The method according to claim 7, wherein the liquid samples to be filtered comprise eluted blood.

11. The system according to claim 3, wherein the seal member is detachable from the nozzle.

12. The system according to claim 1, wherein an outer circumferential portion of the seal member engages with an inner circumferential portion of the upper part of the respective sample well when the seal member engages with the upper part of the respective sample well.

* * * * *